US010415288B2

(12) United States Patent
Rebarchek et al.

(10) Patent No.: US 10,415,288 B2
(45) Date of Patent: Sep. 17, 2019

(54) OPERABLE WALL ASSEMBLY WITH DRIVE SYSTEM

(71) Applicant: HUFCOR, Inc., Janesville, WI (US)

(72) Inventors: Kurt E. Rebarchek, Janesville, WI (US); Dustin W. Miles, Loves Park, IL (US)

(73) Assignee: Hufcor, Inc., Janesville, WI (US)

( * ) Notice: Subject to any disclaimer, the term of this patent is extended or adjusted under 35 U.S.C. 154(b) by 212 days.

(21) Appl. No.: 15/451,829

(22) Filed: Mar. 7, 2017

(65) Prior Publication Data

US 2018/0258676 A1 Sep. 13, 2018

(51) Int. Cl.

| | |
|---|---|
| ***E05D 15/26*** | (2006.01) |
| ***E05F 15/643*** | (2015.01) |
| ***E06B 3/48*** | (2006.01) |
| ***E05F 15/605*** | (2015.01) |
| ***E04B 2/82*** | (2006.01) |
| *E05F 15/646* | (2015.01) |

(52) U.S. Cl.

CPC ..... *E05D 15/26* (2013.01); *E04B 2/827* (2013.01); *E05F 15/605* (2015.01); *E05F 15/643* (2015.01); *E06B 3/481* (2013.01); *E05F 15/646* (2015.01); *E05Y 2900/142* (2013.01)

(58) Field of Classification Search

CPC ..... E04B 2/827; E05Y 2900/142; E05D 15/0608; E05F 15/605; E05F 15/643

See application file for complete search history.

(56) References Cited

U.S. PATENT DOCUMENTS

| | | | | |
|---|---|---|---|---|
| 2,987,121 | A * | 6/1961 | Haws | E04B 2/827 160/188 |
| 3,042,960 | A | 7/1962 | Spork | |
| 3,302,691 | A | 2/1967 | Andrews et al. | |
| 3,414,040 | A * | 12/1968 | Harris | E05F 15/605 160/188 |
| 3,879,799 | A | 4/1975 | Williams | |
| 4,103,463 | A | 8/1978 | Dixon | |
| 4,658,878 | A | 4/1987 | Williams | |
| 5,038,534 | A | 8/1991 | Pollock | |
| 5,152,332 | A * | 10/1992 | Siener | E05F 15/605 160/188 |
| 5,167,575 | A * | 12/1992 | MacDonald | E04B 2/827 454/187 |
| 5,499,671 | A * | 3/1996 | Owens | E05D 15/26 16/94 R |
| 6,079,174 | A | 6/2000 | Williams et al. | |
| 6,470,952 | B1 * | 10/2002 | Cline | E05D 15/266 160/118 |
| 6,571,855 | B1 * | 6/2003 | Goldsmith | E04B 2/827 160/199 |

(Continued)

FOREIGN PATENT DOCUMENTS

FR 753056 10/1933

*Primary Examiner* — Justin B Rephann

(74) *Attorney, Agent, or Firm* — Michael Best & Friedrich LLP

(57) ABSTRACT

An operable wall assembly having a prime mover for deploying and stowing or stacking the wall panels. The operable wall assembly includes a control system for controlling operation of the prime mover and sensors for determining when the panels are fully deployed and fully stacked. The wall panel is installed by applying a three-point camber for spans in the range of 33-40 feet.

19 Claims, 14 Drawing Sheets

FIG. 1

(56) References Cited

U.S. PATENT DOCUMENTS

| | | | | |
|---|---|---|---|---|
| 6,630,755 | B2 * | 10/2003 | Petriello | E05F 15/42 307/112 |
| 6,715,530 | B2 * | 4/2004 | Goldsmith | E05D 15/26 160/199 |
| 7,669,379 | B2 * | 3/2010 | Schierding | E04B 7/045 52/634 |
| 8,534,341 | B2 * | 9/2013 | Coleman | E04B 2/88 160/188 |
| 8,671,633 | B2 * | 3/2014 | Haab | E04B 2/7401 160/206 |
| 2004/0069420 | A1 * | 4/2004 | Petriello | E04B 2/827 160/199 |
| 2011/0247764 | A1 * | 10/2011 | Coleman | E05D 15/063 160/118 |
| 2012/0031002 | A1 * | 2/2012 | Bell | E05D 15/063 49/70 |
| 2013/0008618 | A1 * | 1/2013 | Hall | H02P 7/2913 160/138 |
| 2013/0020036 | A1 * | 1/2013 | Stewart | F16P 3/02 160/188 |
| 2013/0220558 | A1 * | 8/2013 | Knight | E05F 15/76 160/206 |
| 2016/0251852 | A1 * | 9/2016 | Dickson | E04B 2/827 160/7 |
| 2017/0321469 | A1 * | 11/2017 | Jones | E05F 15/643 |
| 2018/0100344 | A1 * | 4/2018 | Knight | E05F 15/605 |

* cited by examiner

OPERABLE WALL ASSEMBLY WITH DRIVE SYSTEM

BACKGROUND

The present invention relates to an operable wall assembly generally of the type disclosed in U.S. Pat. No. 6,079,174 but including a drive system for moving the operable walls between deployed and stacked conditions.

SUMMARY

In one embodiment, the invention provides an operable wall assembly for use in a building having a floor, the operable wall assembly comprising: first and second end supports transferring substantially the entire weight of supported portions of the operable wall assembly to the floor such that the operable wall assembly is substantially free standing; a top support assembly supported at opposite ends by the first and second end supports, the top support assembly including a track, a space being bounded by the first and second end supports, top support assembly, and floor; a plurality of wall panels suspended from the top support assembly and movable along the track between a deployed condition in which the wall panels close the space and a stacked condition in which the wall panels do not close the space; a prime mover; and a drive system supported by the first and second end supports and interconnected between prime mover and the wall panels to move the wall panels between the deployed condition and stacked condition under the influence of the prime mover.

The invention also provides an operable wall assembly for use in a building having a floor, the operable wall assembly comprising: first and second end supports transferring substantially the entire weight of the operable wall assembly to the floor such that the operable wall assembly is substantially free standing; a top support assembly supported at opposite ends by the first and second end supports, the top support assembly including a track and a chain runner adjacent the track, a space being bounded by the first and second end supports, top support, and floor; a plurality of wall panels suspended from the top support assembly and movable along the track between a deployed condition in which the wall panels close the space and a stacked condition in which the wall panels do not close the space; a motor; a drive sprocket rotated by the motor; and a chain supported by the chain runner and interconnected between a least one of the wall panels and the drive sprocket to move the wall panels between the deployed condition and stacked condition under the influence of the motor and chain.

The invention also provides a method of assembling an operable wall assembly in a building having a floor, the method comprising the steps of: supporting with first and second end supports a top support assembly extending between the first and second end supports, the top support assembly including a track, to define a space bounded by the first and second end supports, top support, and floor; providing a drive system; providing a prime mover; suspending from the track a plurality of wall panels movable along the track between a deployed condition in which the wall panels close the space and a stacked condition in which the wall panels do not close the space; and interconnecting the drive system between the prime mover and at least one of the operable wall panels such that the prime mover is able to move the wall panels between the deployed and stacked conditions.

The invention also provides a method of retrofitting a substantially free-standing operable wall assembly having an overhead track supporting operable wall panels, the method comprising the steps of: providing a prime mover; and interconnecting a force transfer member between at least one of the operable wall panels and the prime mover such that the operable wall panels are movable under the influence of the prime mover.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
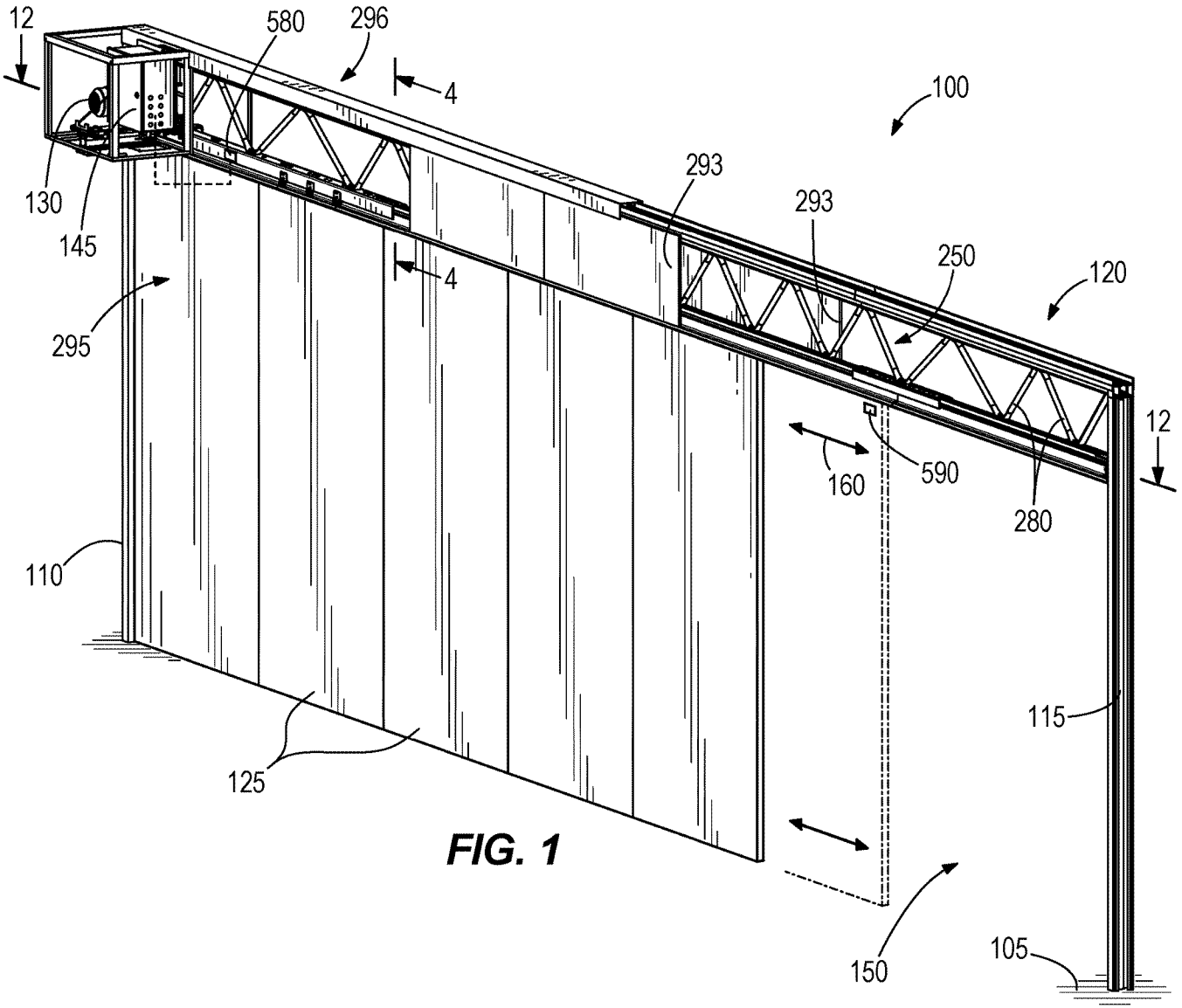
FIG. 1 is a perspective view of an operable wall assembly embodying the present invention and showing the wall panels deployed.
Figure 2:
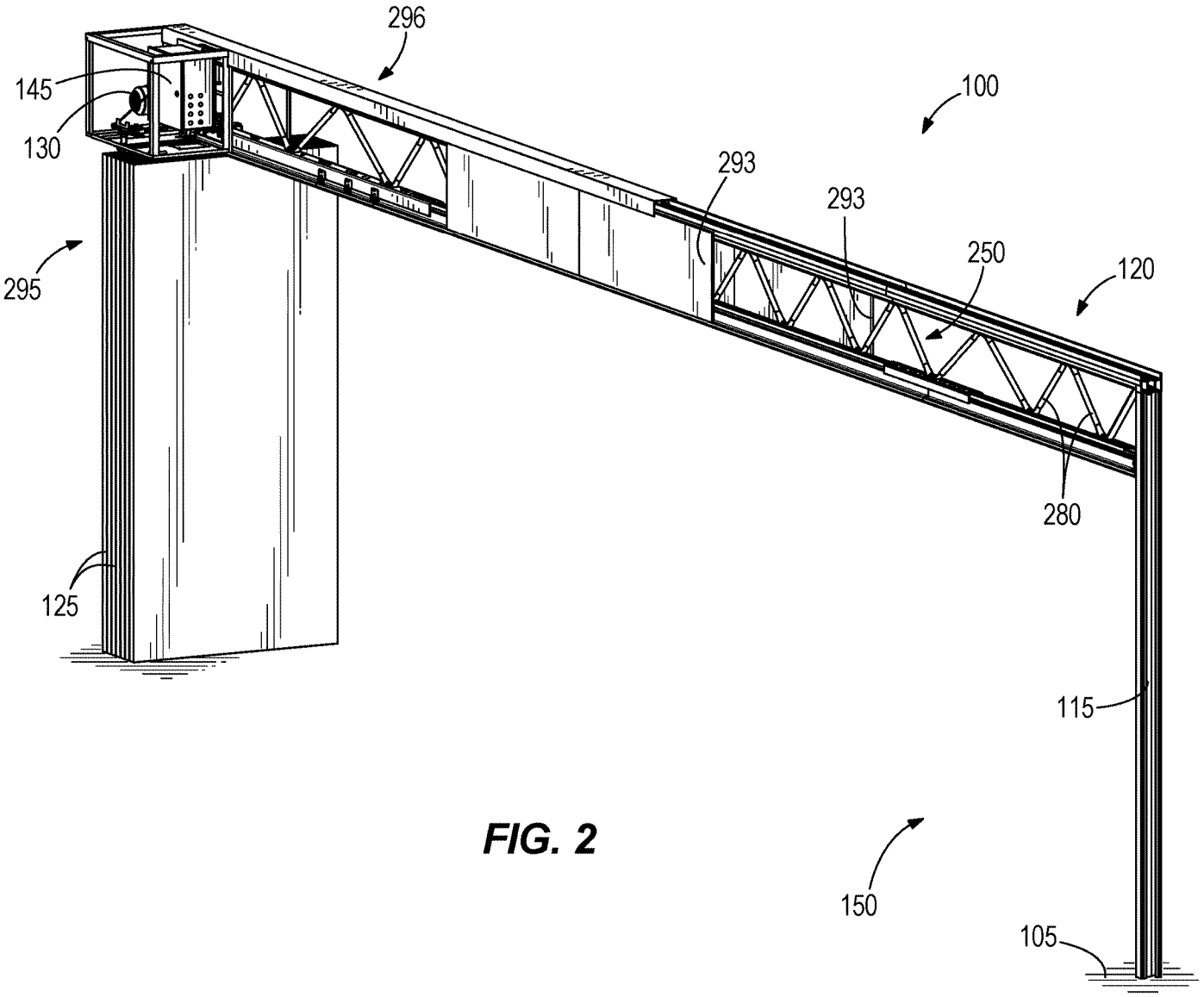
FIG. 2 is a perspective view of the operable wall assembly with the wall panels stowed.

FIGS. 1 and 2 illustrate an operable wall assembly 100 for use in a building having a floor 105. As will be discussed in more detail below, the operable wall assembly 100 is configurable in or movable between a deployed condition (FIG. 1) and a stacked condition (FIG. 2). The present invention is generally concerned with moving the operable wall assembly 100 between the deployed and stacked conditions with a prime mover as opposed to manually.

The operable wall assembly 100 includes a first end support 110, a second end support 115, a top support assembly 120, a plurality of wall panels 125, a prime mover 130, a drive system 135 (FIG. 7), and a control system 145. A space 150 is bounded by the first and second end supports 110, 115, the top support assembly 120, and the floor 105. The plurality of wall panels 125 are suspended from the top support assembly 120 and are movable in the directions indicated with arrows 160 between the deployed condition (FIG. 1) and the stacked condition (FIG. 2). The vertical edge of each panel 125 that is closest to the second end support 115 will be referred to as the "leading edge" of the panel 125 and the vertical edge closest to the first end support 110 will be referred to as the "trailing edge." The leading edge of each panel 125 is pivotally connected to the trailing edge of the adjacent panel 125 so that the panels zig-zag when they are moved between the stacked and deployed conditions (see FIGS. 11-13). The panel 125 closest to the second end support 115 will be referred to as the "lead panel" and the panel 125 closest to the first end support 110 will be referred to as the "stack panel." The wall panels 125 close the space 150 when the operable wall assembly 100 is in the deployed condition and do not close the space 150 (i.e., at least partially open the space 150) when the operable wall assembly 100 is in the stacked condition.

The first and second end supports 110, 115 transfer substantially the entire weight of supported portions of the operable wall assembly 100 to the floor 105 such that the operable wall assembly 100 is substantially free standing. As used herein, the term "free standing" means that all vertical support for supported portions of the operable wall assembly 100 is provided by the first and second end supports 110, 115 and the floor 105. As will be discussed in further detail below, some portions of the operable wall assembly 100, such as the prime mover 130, may be supported by the first and second end supports 110, 115 in some constructions of the present invention and in other constructions may be supported elsewhere. When portions of the operable wall assembly 100 are supported elsewhere, they are not deemed part of the "supported portions" of the operable wall assembly 100 carried by the first and second end supports 110, 115, so the operable wall assembly may still be considered "free standing" even if one or more portions are supported elsewhere. Additionally, the term "free standing" contemplates that the operable wall assembly 100 may be supported by other supports to reduce or prevent horizontal swaying or tipping. For example, the operable wall assembly 100 may be interconnected to walls or building structure adjacent the first and second end supports 110, 115 to reduce horizontal swaying or tipping and the fact that such walls or building structure also provides nominal or de minimis vertical support does not mean that the operable wall is not free standing as that term is used herein. Another example of other support for the free standing operable wall assembly may be provided by a cap structure to accommodate vertical deflection of the building's roof, as in the operable wall assembly disclosed in U.S. Pat. No. 6,079,174 owned by the present applicant. Again, simply because such structure provides horizontal stability and possibly some de minimis vertical support (e.g., through friction or engagement of small parts) does not render the wall not free standing under the present disclosure. Yet another example of structure that may provide additional support to a free standing operable wall assembly is a track or seal engaging between the floor 105 and the lower ends of the wall panels 125.

Figure 3:
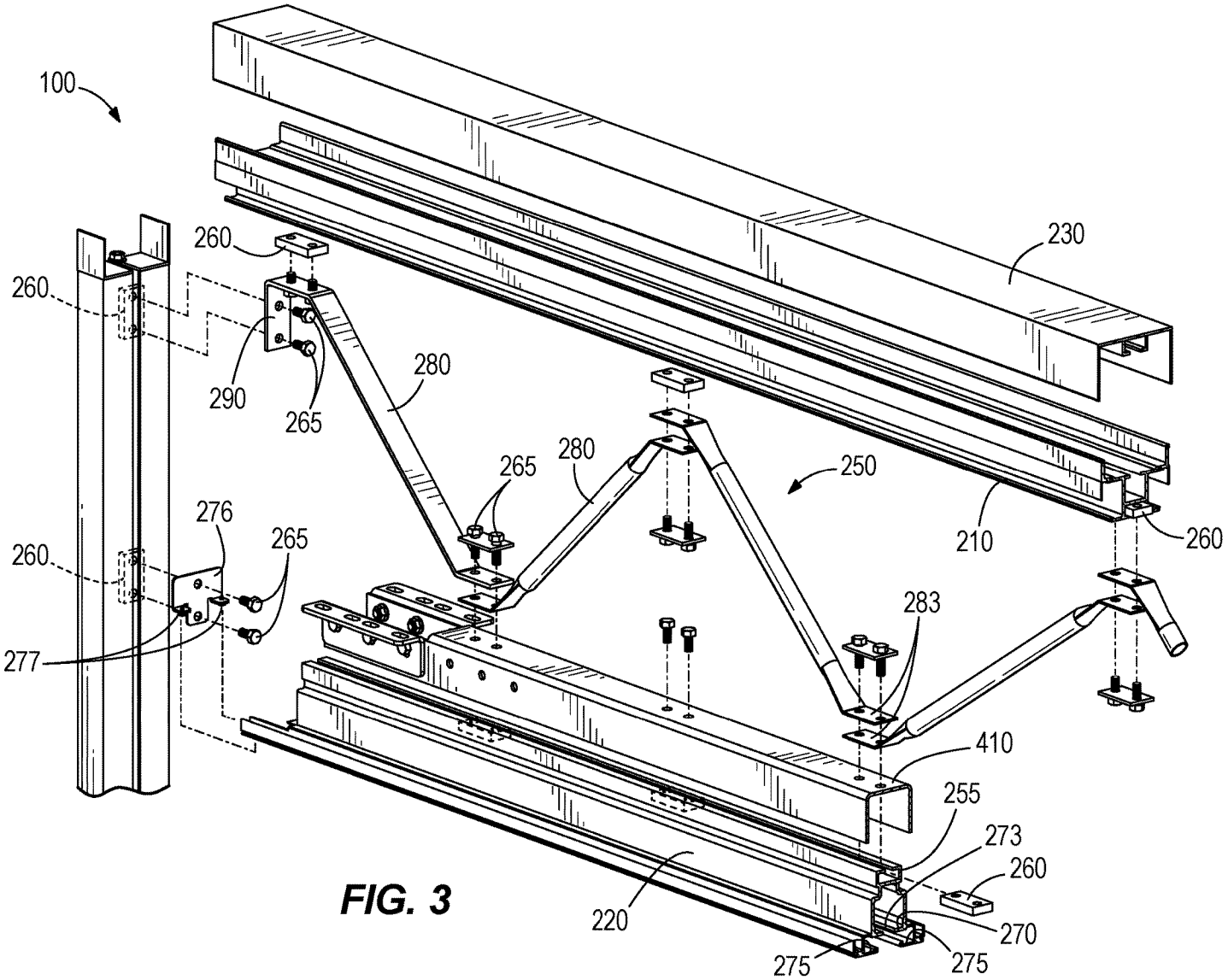
FIG. 3 is an exploded view of a portion of a top support assembly portion of the operable wall assembly.
Figure 4:
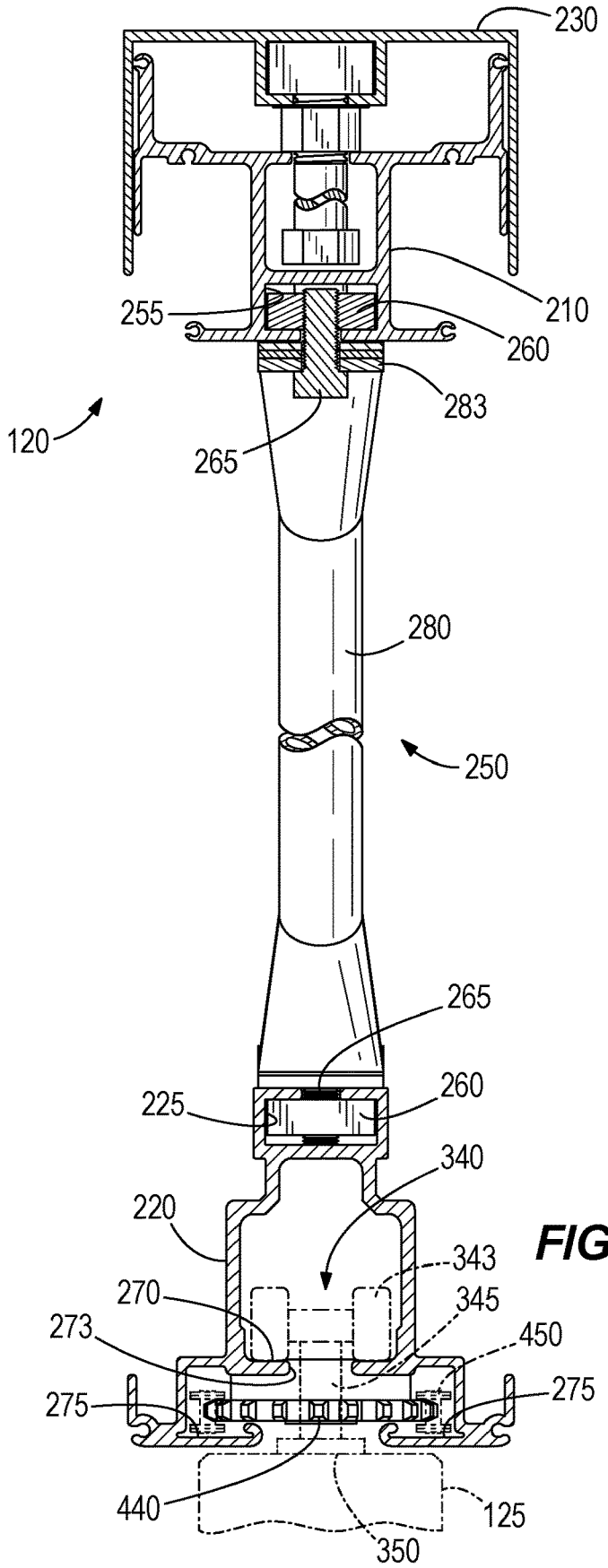
FIG. 4 is an cross sectional view of the top support assembly.

With reference to FIGS. 3 and 4, the top support assembly 120 is supported at opposite ends by the first and second end supports 110, 115. The top support assembly 120 includes a top rail or chord 210, a bottom rail or chord 220, a cap 230, and a truss assembly 250. The top chord 210 and bottom chord 220 are extrusions (e.g., aluminum extrusions), each of which defines a channel 255 with a slot opening toward the truss assembly 250. Spacers 260 (received in the channels 255) and fasteners 265 are used to connect the truss assembly 250 to the top and bottom chords 210, 220. Spacers 260 are also received in similar channels in the end supports 110, 115 to secure the truss assembly 250 and bottom chord 220 to the end supports 110, 115.

Figure 9:
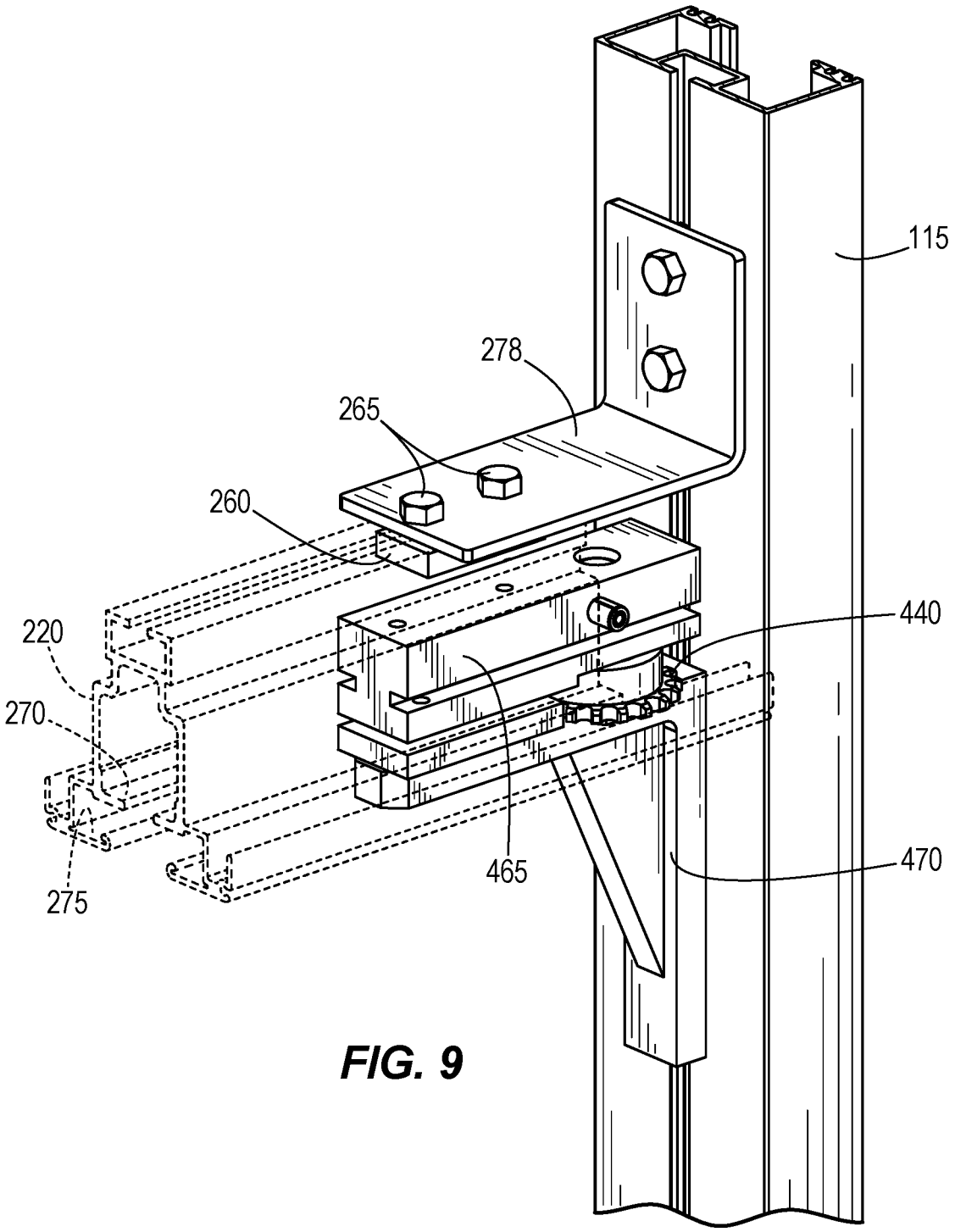
FIG. 9 is a perspective view of a return sprocket end of the operable wall assembly.
Figure 10:
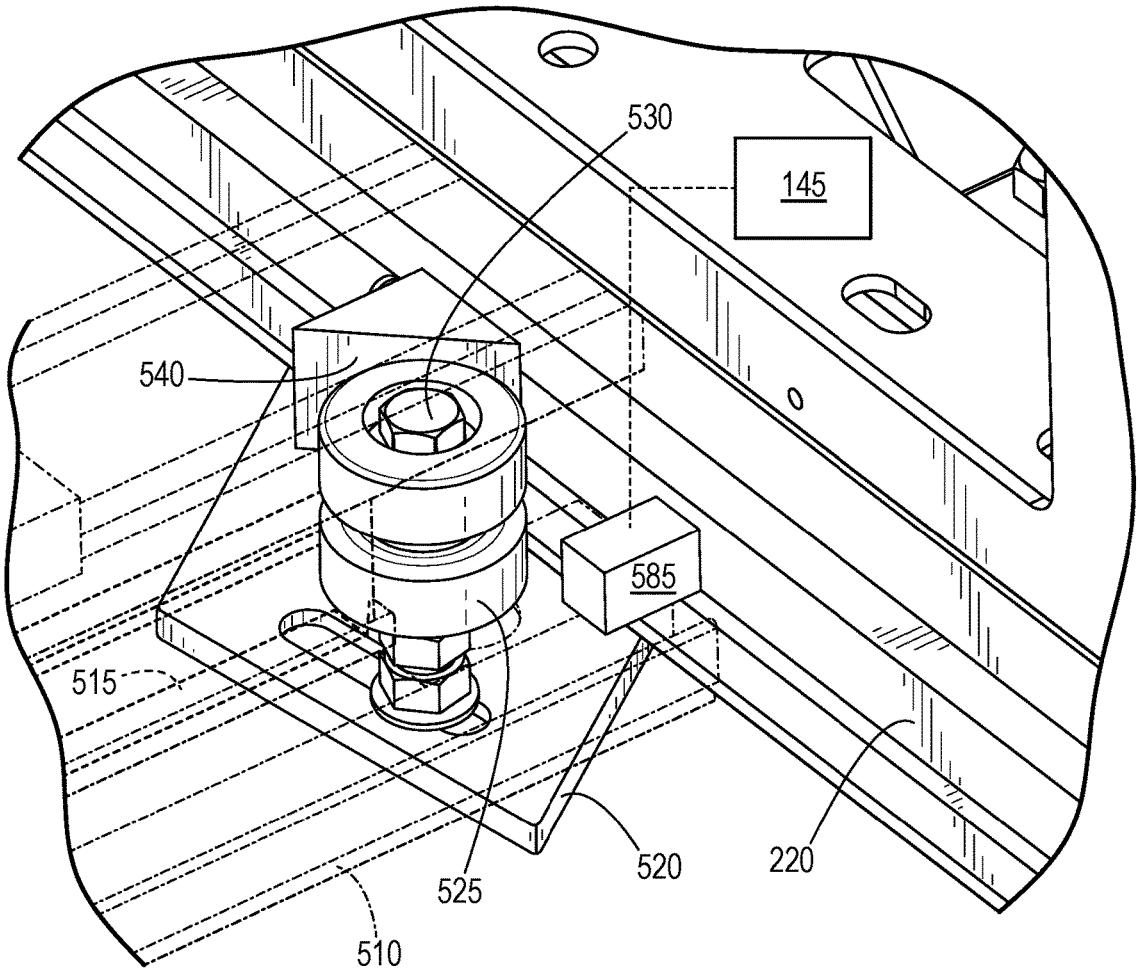
FIG. 10 is a perspective view of a diverter and outboard arm for the stack panel.

The bottom chord 220 also defines a track 270 for supporting the wall panels 125, as will be described in more detail below. The track 270 includes a slot 273 opening down toward the wall panels 125. Integrally formed with the bottom chord 220 or track 270 are a pair of runners 275 to support a portion of the drive system 135 as will be described in more detail below. The runners 275 extend alongside, parallel to, outboard of (i.e., on either side of), and below the track 270, between the first and second end supports 110, 115. In other embodiments of the invention, the runners 275 or portions of the runners 275 may be formed separately from the track 270 and be attached during manufacture or assembly. In other embodiments, depending on the configuration of the drive system 135, a single runner 275 may be provide along only one side of the track 270. The first end (i.e., the end adjacent the first end support 110) of the bottom chord 220 is mounted to the first end support 110 by way of a mounting bracket 276 (FIG. 3) that includes torque-resisting tabs 277 that are fastened to the free ends of the runners 275. The second end of the bottom chord 220 is mounted to the second end support 115 by way of an angle bracket 278 (FIG. 9).

The cap 230 covers the top and sides of the top chord 210. The cap 230 may be secured to the framework (e.g., beams or joists of the ceiling or roof) of the room or building in which the operable wall assembly 100 is installed. In addition to providing a finished appearance to the top chord 210, the cap 230 may also serve a structural purpose similar to that described in U.S. Pat. No. 6,079,174, the disclosure of which is incorporated herein by reference. More specifically, the cap 230 may accommodate vertical movement of the roof or ceiling of the building relative to the free-standing operable wall assembly 100 (e.g., when loads are applied to or removed from the roof or ceiling, causing the building or room framework to lower or rise) without applying a significant vertical loading to the operable wall assembly 100. Stated another way, the cap 230 may provide a lost motion function to accommodate vertical movement or variations in the framework of the building or room to decouple such movement or variations from the operable wall assembly 100. At the same time, because the cap 230 covers or embraces the sides of the top chord 210, the cap 230 provides lateral (i.e., in non-vertical directions perpendicular to the longitudinal axis of the top chord 210) stability to the operable wall assembly 100.

The truss assembly 250 is interconnected between the top chord 210 and the bottom chord 220. More specifically, the truss assembly 250 comprises a plurality of webs 280 extending at non-vertical and non-horizontal (i.e., diagonally) between the top and bottom chords 210, 220. The webs 280 include flat ends 283 that overlap and attach to the spacers 260 with fasteners 265. The webs 280 at the ends of the top support assembly 120 also include a vertical flat end 290 that mount to spacers 260 in the first and second end supports 110, 115 using similar fasteners 265. To improve stability and help with bearing the load of the illustrated operable wall assembly 100, including the prime mover 130, the drive system 135, and the control system 145, the flat ends 283, 290 of the webs 280 are each mounted to the respective spacers 260 with two fasteners 265 in the form of bolts in the illustrated embodiment.

Referring again to FIGS. 1 and 2, the top support assembly 120 may also include noise reducing panels 293 mounted between the top and bottom chords 210, 220 between the first and second end supports 110, 115. The top support assembly 120 includes a first side 295 and second oppositely-facing side 296. As illustrated, the prime mover 130 and the control system 145 are both mounted to the first side 295 of the top support assembly 120, and the second side 296 has a finished and clean appearance. The terms first side 295 and second side 296 can be applied for reference to any components of the operable wall assembly 100 and the operable wall assembly 100 generally. This may be useful in retail or other settings involving customers or clients, in that the second side 296 can face out toward the customers or clients (i.e., a "customer-facing" or "client-facing" side or storefront) while the prime mover 130 and control system 145 are hidden from view. In other constructions, the prime mover 130 and control system 145 may be supported elsewhere and not be carried by the top support assembly 120 (i.e., they may not be "supported portions"). For example, the prime mover 130 and/or control system 145 may be independently mounted to the structure of the building or room.

Figure 5:
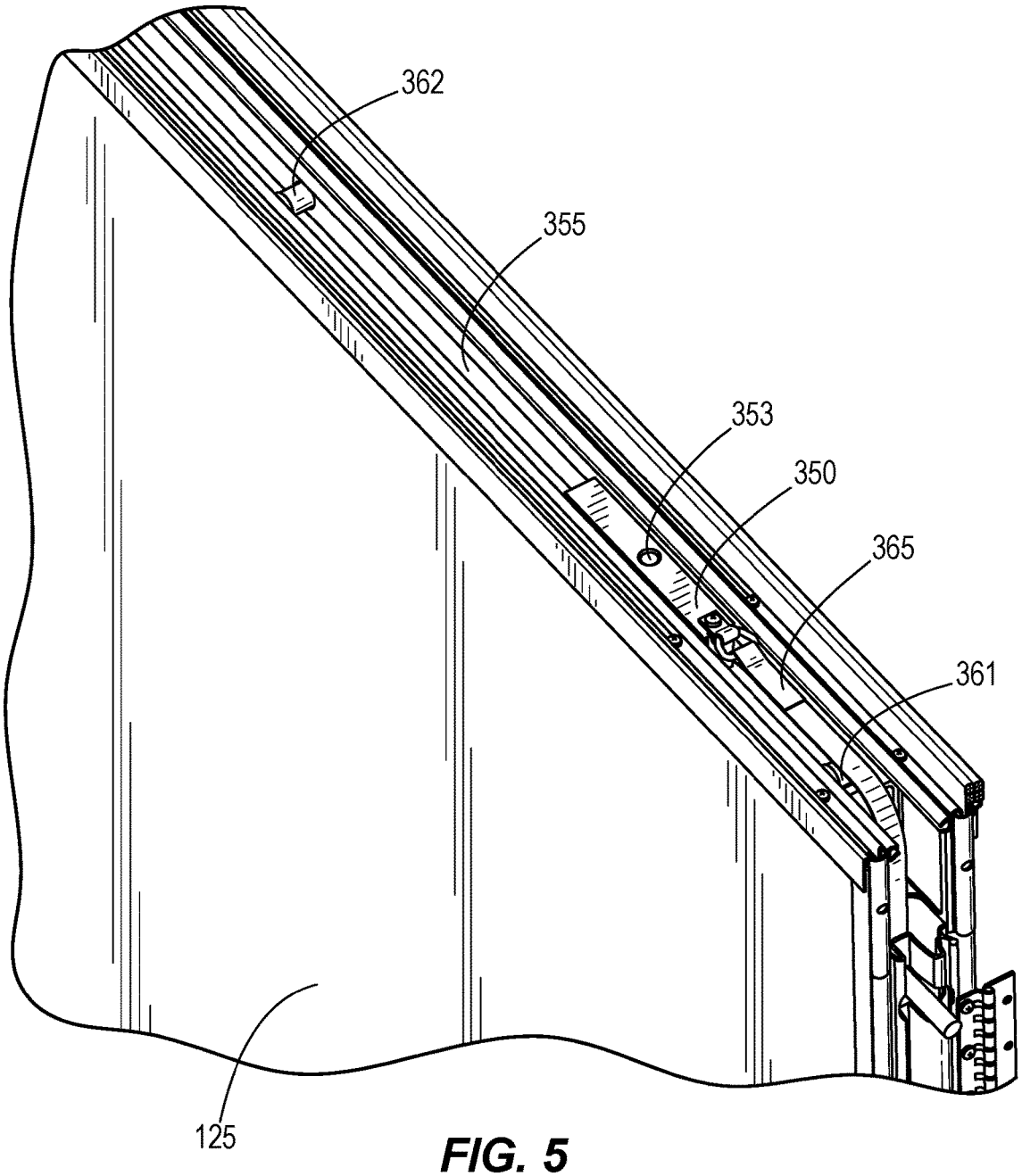
FIG. 5 is a top perspective view of one of the wall panels.
Figure 11:
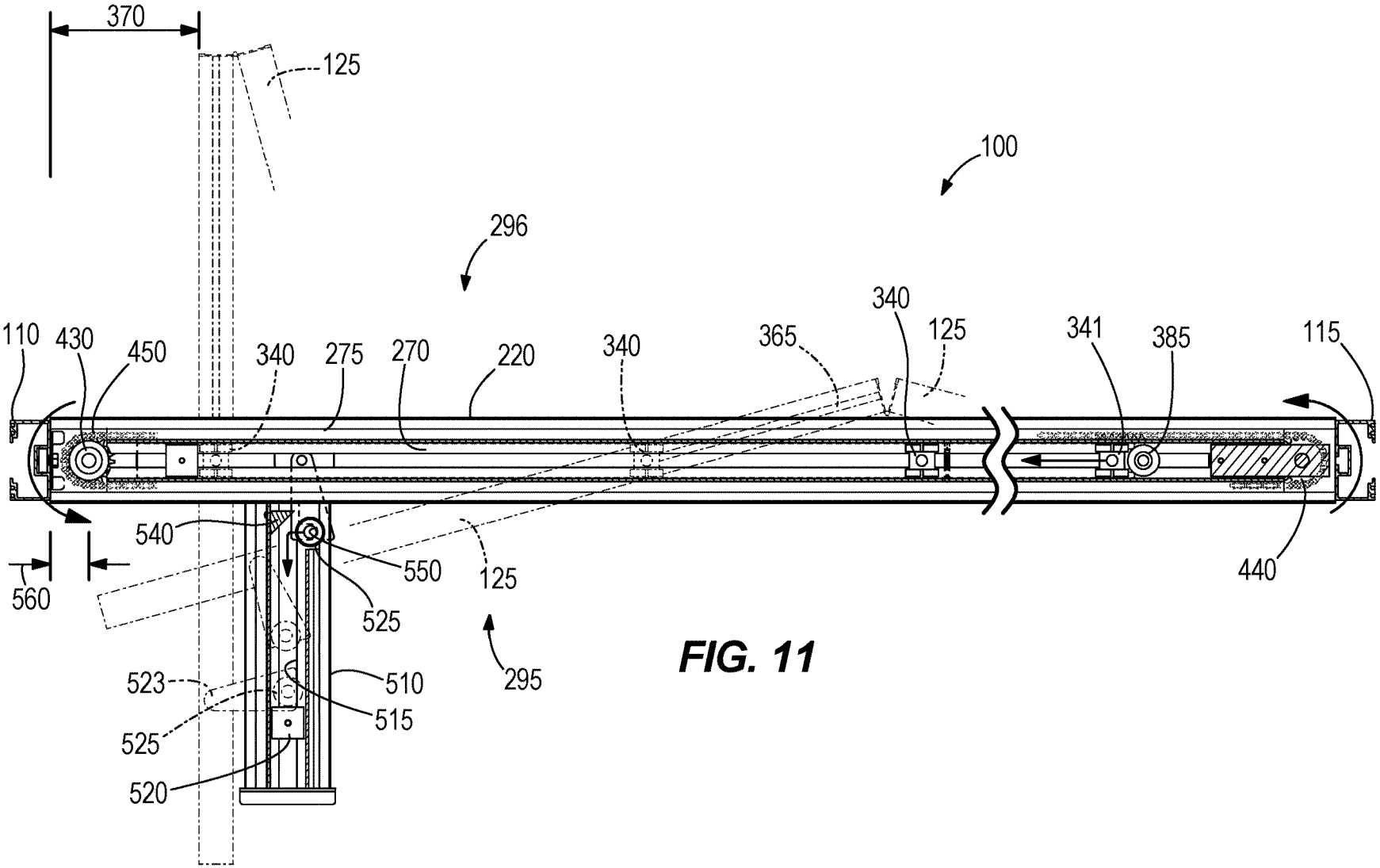
FIG. 11 is a top view of the operable wall assembly showing the initial movement of the stack panel being stowed.
Figure 12:
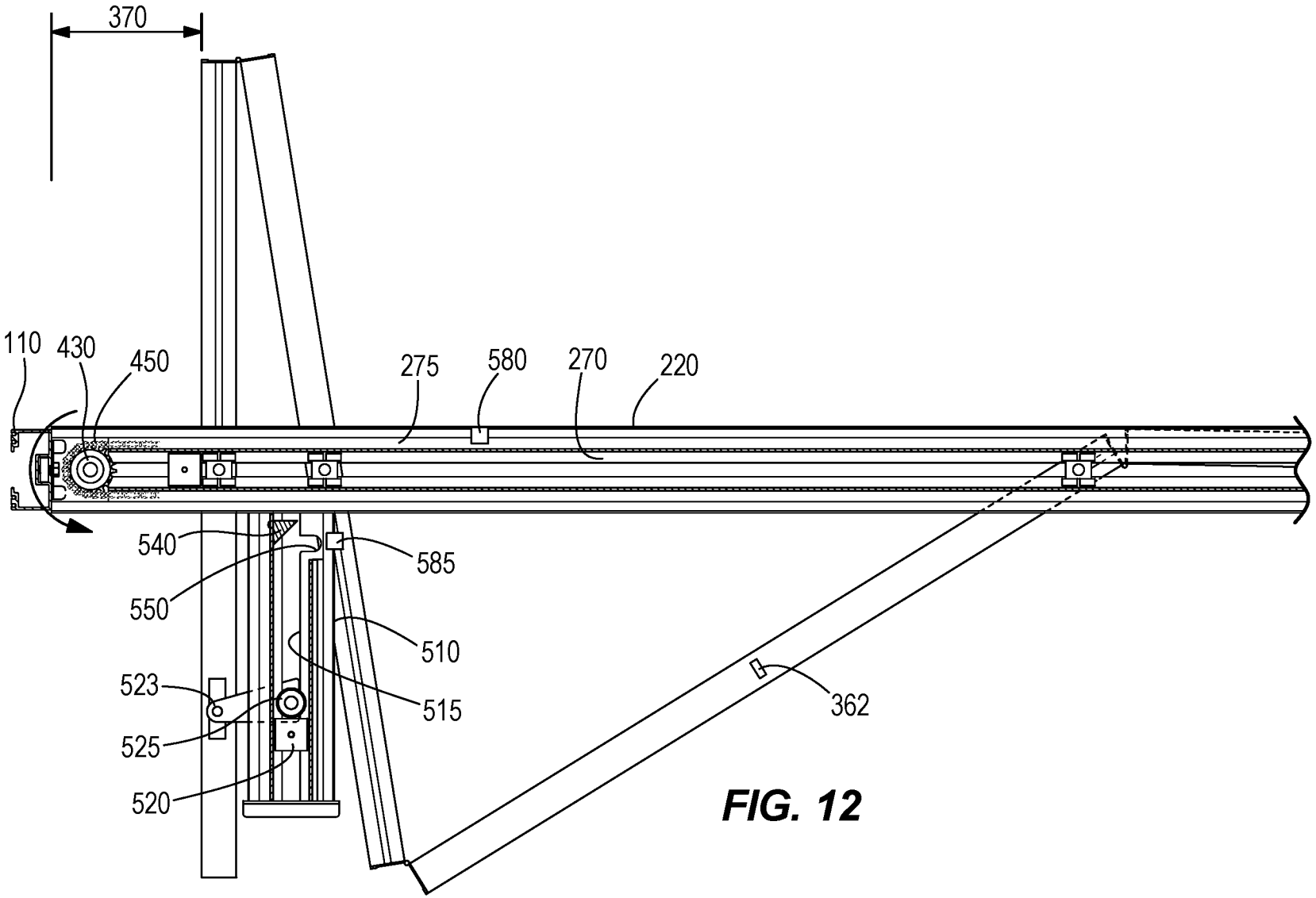
FIG. 12 is a top view of the operable wall assembly showing wall panels being stowed.
Figure 13:
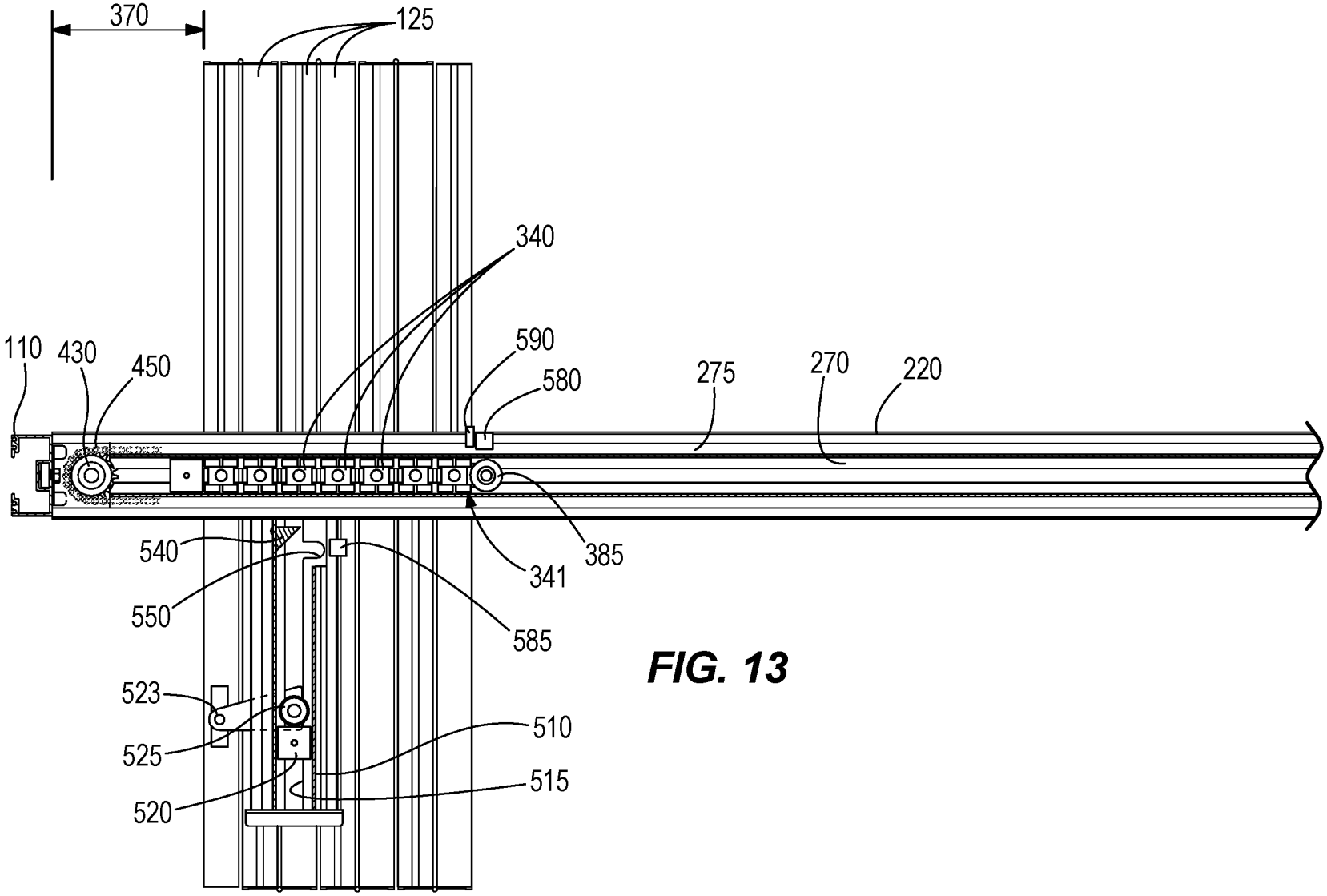
FIG. 13 is a top view of the operable wall assembly in the fully stowed condition.

Referring to FIGS. 4-5, the wall panels 125 are suspended from the track 270 by way of a plurality of panel carriers 340. The panel carriers 340 each include a car with rollers 343, a vertically extending hanger 345 that extends from the car through the slot 273 in the track 270, a carrier plate 350 that rides in a slot 355 (FIG. 5) in the top of a wall panel 125. The carrier plate 350 includes a hole 353 that receives the hanger 345. The range of motion of the carrier plate 350 in the slot 355 is bounded by a first stop 361 and a second stop 362. A strap 365 interconnects the carrier plate 350 to a spring (e.g., a coil spring or linear spring, not illustrated) in the panel 125, to bias the carrier plate 350 toward the first stop 361. The wall panels 125 are adapted to move along the track 270 by virtue of the rollers 343 rolling along the track 270. When in the deployed condition, the carrier plate 350 is generally held against the first stop 361 by the biasing force of the spring acting through the strap 365. As illustrated in FIGS. 11-13, as the panels 125 are moved into the stacked condition, the panels 125 turn ninety degrees with respect to the track 270 and stack flat against each other (with a gap 370 between the stack panel and the first end support 110). As will be described in more detail below, to accommodate the ninety-degree turn of the panels 125, the carrier plates 350 move along the slot 355 toward the second stop 362 to center the panel carriers 340 with respect to the panels 125 when the panels 125 are stacked.

Figure 6:
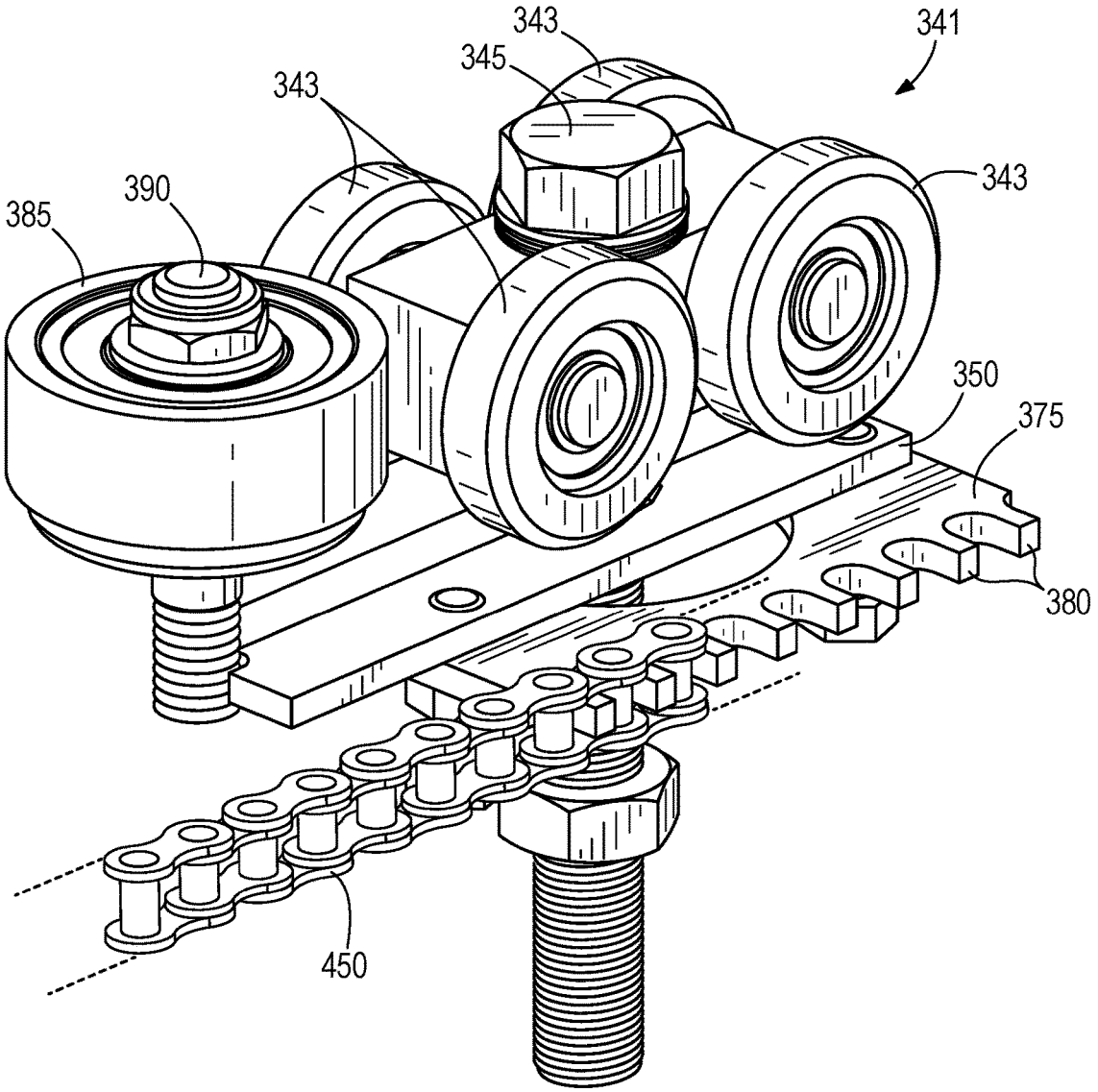
FIG. 6 is a perspective view of a lead carrier.

FIG. 6 illustrates the lead carrier 341, which supports the lead panel 125 (i.e., the panel 125 that contacts the second end support 115 when the panels 125 are fully deployed). The lead carrier 341 includes all components of the panel carrier 340 discussed above and also a couple additional features that are not included in the other panel carriers 340 in the illustrated embodiment. First, the lead carrier 341 includes a toothed plate 375 having teeth 380 along one side. The teeth 380 extend into the space above the runner 275 and engage a component of the drive system 135 (e.g., a chain) so that the lead panel 125 can move under the influence of the prime mover 130, as will be described below. Because the teeth 380 are horizontally offset from the vertical axis of the hanger 345, linear forces (i.e., parallel but offset from the longitudinal axis of the bottom chord 220) applied to the lead carrier 341 by the drive system 135 through the teeth 380 give rise to torsional forces on the lead carrier 341 and lead panel 125 about the vertical axis of the hanger 345. The second feature is a horizontal stabilizer wheel 385 that is supported for rotation about a vertical axle 390 mounted to the carrier plate 350. The stabilizer wheel 385 rolls along the inner side surfaces of the bottom chord 220 to bear some of the torsional load arising from linear forces on the teeth 380 just described above. The stabilizer wheel 385 thus helps the system operate more smoothly. As noted above, only the lead carrier 341 includes the toothed plate 375 and stabilizer wheel 385 in the illustrated embodiment.

Figure 7:
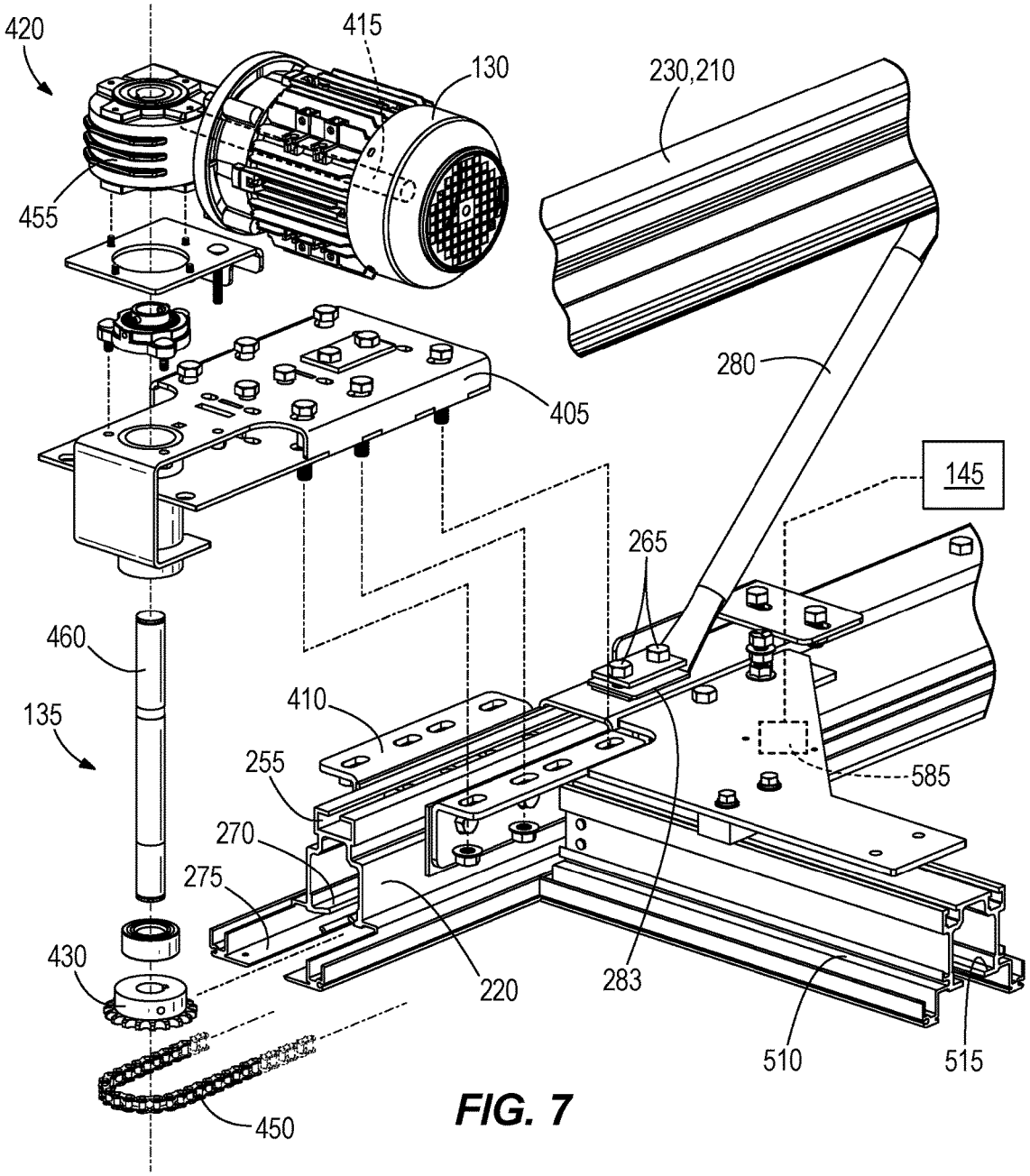
FIG. 7 is an exploded view of a portion of a drive system 135 of the operable wall assembly.

Referring now to FIG. 7, the prime mover 130 is mounted to and sits on a support plate 405. The support plate 405 is mounted to a mounting bracket 410 that is in turn mounted to the bottom chord 220. In the illustrated embodiment, the prime mover 130 is an electric motor. The term "prime mover" is intended to be interpreted broadly to include any device providing a motive force to move the panels between the deployed and stacked conditions. The prime mover 130 may include an energy storage component, such as a spring. The prime mover 130 includes a horizontally-extending output shaft 415 which may be called a motor output shaft in the illustrated embodiment. The prime mover 130 operates at the instruction of the control system 145 in a stacking mode (in which the prime mover 130 moves the panels 125 toward the stacked condition) and a deploying mode (in which the prime mover 130 moves the panels 125 toward the deployed condition).

Figure 8:
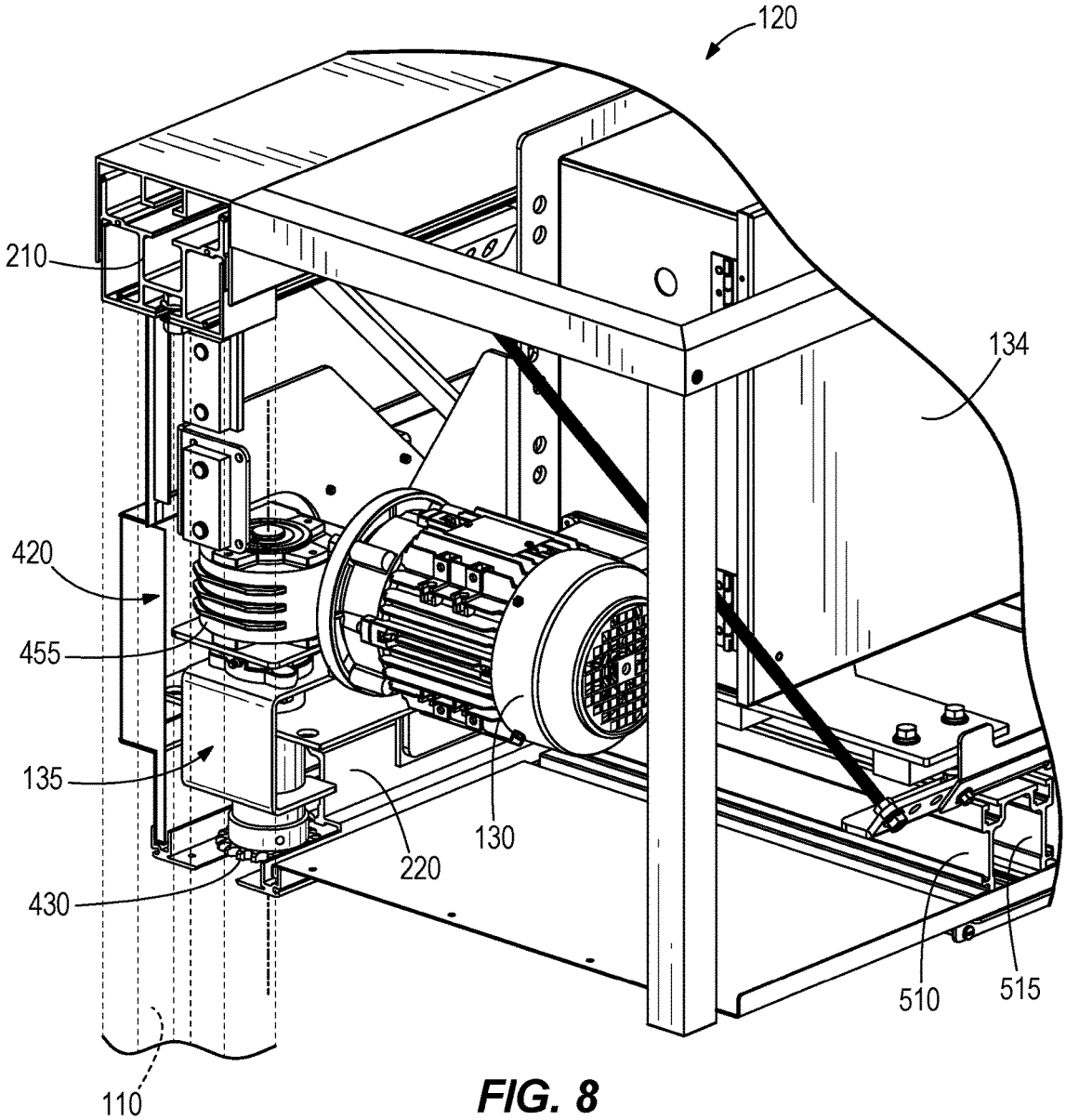
FIG. 8 is a perspective view of the drive system.

With reference to FIGS. 7-9, the illustrated drive system 135 includes a transmission 420, a drive sprocket 430, a return sprocket 440, and a chain 450. The transmission 420 includes a gear box 455 and a transmission shaft 460. The gear box 455 is mounted to the support plate 405 and receives the output shaft 415 of the prime mover 130. The gear box 455 rotates the transmission shaft 460, which is supported for rotation by bearings mounted to the support plate 405, in response to rotation of the output shaft 415. The gear box 455 may cause the transmission shaft 460 to rotate at a speed equal to, greater than, or lower than the speed of the output shaft 415, depending on the design of the overall operable wall assembly 100. For example, the gear box 455 may operate as a speed reducer to deliver more torque with the transmission shaft 460 than would be available directly from the output shaft 415. The transmission shaft 460 is vertically oriented, such that the illustrated configuration of the transmission 420 converts rotation and torque about a horizontal axis (from the output shaft 415) into rotation and torque about a vertical axis (through the transmission shaft 460).

As illustrated in FIGS. 7 and 8, the end of the bottom chord 220 near the first end support 110 accommodates the drive sprocket 430. More specifically, the runners 275 extend beyond the end of the track 270 so that the drive sprocket 430 can be positioned adjacent the runners 275 to mesh with the chain 450. In a similar way, as illustrated in FIG. 9, the opposite end of the bottom chord 220 (near the second end support 115) accommodates the return sprocket 440 by extending the runners 275 beyond the end of the track 270. The return sprocket 440 is supported for rotation about a vertical spindle of a return sprocket main block 465 that is received in the bottom chord 220 and mounted to the second end support 115 by way of a truss bracket 470.

The chain 450 meshes with the drive sprocket 430 and return sprocket 440, and is supported by the runners 275 in the bottom chord 220 (see also FIG. 4) along both the first side 295 and second side 296 of the truss assembly 250. As illustrated in FIG. 11, the chain 450 slides along the runners 275 in a loop between the drive sprocket 430 and return sprocket 440. The chain 450 meshes with the teeth 380 of the toothed plate 375 to transfer a linear force generated by the prime mover 130 (through the gear box 455, transmission shaft 460, drive sprocket 430 and chain 450) to the lead carrier 341 through the carrier plate 350. The chain 450 may be referred to more generically as a "force transmitting member" and or a "flexible force transmitting member." In other embodiments of the invention, the chain 450 can be replaced with other force transmitting members or flexible force transmitting members such as a belt, strap, or cable.

Referring now to FIGS. 7 and 11-13, the top support assembly 120 further includes an outboard arm 510 to facilitate stacking the panels 125 in the deployed condition. The outboard arm 510 is perpendicular to the bottom chord 220 and is positioned under the prime mover 130 near the first end support 110. In the illustrated embodiment, the outboard arm 510 is about 14 inches from the first end support 110, but in other embodiments the spacing may be between 8-20 inches. The outboard arm 510 is an extruded piece with a track 515 substantially identical to the track 270 in the bottom chord 220.

Referring now to FIGS. 7 and 10-13, the stack panel 125 includes an additional stack carrier 520 having an offset bracket 523. The offset bracket 523 carries a diverter roller 525 supported by a vertical axle 530. The diverter roller 525 rotates in a horizontal plane. A diverter surface 540 is angled about 45° between the tracks 270, 515. The stack carrier 520 resides in track 515. The diverter roller 525 is received in a notch 550 in the outboard arm 510 when the panels 125 are fully deployed. The notch 550 embraces the diverter roller 525 to resist side-to-side movement of the trailing edge of the stack panel 125.

The panel carrier 340 of the stack panel 125 is positioned in front of the diverter surface 540 (i.e., the diverter surface 540 is between the first end support 110 and the carrier 340) when the stack panel 125 is deployed. As seen in FIG. 11, there is a small gap 560 (e.g., about 8 inches in the illustrated embodiment) between the trailing edge of the stack panel 125 and the first end support 110 when the panels 125 are deployed. The small gap 560 is covered with an angled molding on the second side 296 of the operable wall assembly 100 so the small gap is not visible from the "finished" side.

When the prime mover is operating in a stacking mode, it pulls the lead panel 125 toward the first end support 110, which moves all panels 125 in that direction. The small gap 560 between the trailing edge of the stack panel 125 and the first end support 110 accommodates the initial movement of the panels 125 in this direction, and permits the diverter roller 525 to move out of the notch 550 and into contact with the diverter surface 540. In response to continued rearward movement of the stack panel 125, the stack carrier 520 rolls along the diverter surface 540 and in the outboard track 515. As seen in FIG. 11, movement of the stack carrier 520 along the diverter surface 540 causes the stack panel 125 to start pivoting about its panel carrier 340, with the trailing edge of the stack panel 125 sweeping out of alignment with the bottom chord 220 on the first side 295 and the leading edge of the stack panel 125 sweeping out of alignment on the second side 296.

As the prime mover 130 continues to operate in stacking mode, the stack carrier 520 moves along the outboard track 515 and the stack panel 125 continues to pivot toward a perpendicular orientation with respect to track 270. As the stack panel 125 pivots, its leading edge applies an off-axis force on the trailing edge of the adjacent panel 125. This causes the adjacent panel 125 to start to turn with respect to the track 270 and sets off a chain reaction in which each panel 125 causes the next panel 125 to start to turn, resulting in the zig-zag pattern of panels illustrated in FIGS. 11 and 12.

As the panels 125 turn, the panel carriers 340, which are retained in the track 270, move along the top edges of the panels 125 against the biasing force of the spring and strap 365, as discussed above with respect to FIG. 5. The panels 125 are dimensioned such that they are stacked in the stacked condition simultaneously with the panel carriers 340 abutting the second stop 362 in the slot 355 in the top edge of each panel 125.

The control system 145 monitors the status of a stack limit switch 580 (FIGS. 1, 12 and 13) and a deploy limit switch 585 (FIGS. 7, 10, 12, and 13) to control the prime mover 130 operating in respective stacking and deploying modes. The control system 145 includes a controller which is in communication with the switches 580, 585 via wired or wireless connections. The control system 145 monitors the stack limit switch 580 while operating the prime mover 130 in stacking mode and monitors the deploy limit switch 585 while operating the prime mover 130 in deploying mode.

Referring to FIGS. 1, 12 and 13, the stack limit switch 580 is mounted to the top support assembly 120 near (or on) the bottom chord 220 and may be, for example, a magnetic switch. As illustrated in FIGS. 1 and 13, the lead panel 125 or lead carrier 341 includes a complimentary component 590 (e.g., a magnet) that is recognized by the stack limit switch 580. The stack limit switch 580 is positioned on the top support assembly 120 such that it recognizes the complimentary component 590 when the lead panel 125 stacked. Upon recognizing the complimentary component 590, the stack limit switch 580 sends a signal to the control system 145 and the control system 145 turns off the prime mover 130. In other embodiments, the stack limit switch 580 and complimentary component 590 may be a contact switch or any other suitable switch.

Referring to FIGS. 7, 10, 12, and 13, the deploy limit switch 585 is positioned adjacent the notch 550 and may be a contact switch, for example. As noted above, the diverter roller 525 is received in the notch 550 when the panels are deployed. When received in the notch 550, the diverter roller 525 engages the deploy limit switch 585. Upon being engaged, the deploy limit switch 585 sends a signal to the control system 145 to turn off the prime mover 130. In other embodiments, the deploy limit switch 585 may be a magnetic switch or other suitable switch.

Figure 14:
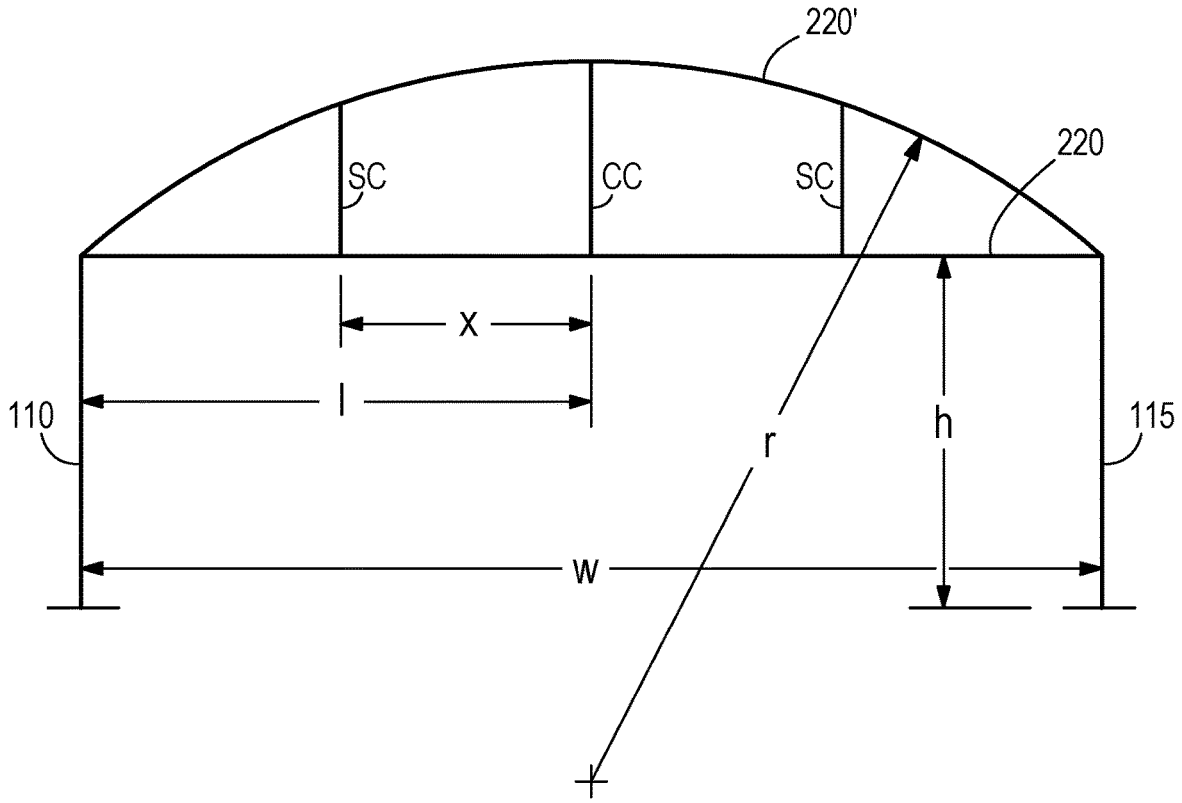
FIG. 14 is a schematic illustration of camber being applied to a bottom chord of the top support assembly.

Installation of the operable wall system 100 will now be described with reference to FIG. 14. During installation of the operable wall system 100, a camber is intentionally imparted (or preloaded) to the bottom chord 220 to properly offset the expected weight of the panels 125 in the deployed condition. FIG. 14 illustrates the bottom chord 220 in its at-rest condition and in a cambered condition 220'; the cambered condition 220' is greatly exaggerated for illustrative purposes. The camber is applied such that the bottom chord 220 is non-horizontal with the wall panels 125 in the stacked condition but becomes substantially horizontal with the wall panels 125 in the deployed condition when the bottom chord 220 is bearing the load of the panels 125 across its full span. After creating the desired camber to the bottom chord 220, the fasteners 165 are secured to the spacers 260 that secure the webs 280 of the truss assembly 250 to the bottom chord 220. It is expected that the top support assembly 120 will relax after securing the fasteners 165 and spacers 260 to the preloaded bottom chord 220, causing the bottom chord 220 to lose some degree of camber. As a result, the camber preloaded to the bottom chord 220 should normally exceed the desired camber by some measure to arrive at the ultimately-desired camber.

A free-standing operable wall system 100 such as that illustrated in FIGS. 1 and 2 can generally handle the load of the panels without any preset camber for spans "w" (i.e., distances between the first and second end supports 110, 115) up to about 25 ft. When the span "w" is 25-33 feet, a single point camber is used, in which the bottom chord 220 is jacked up at a single point, usually at the center of the span. For spans "w" of about 33-40 ft., the present invention provides a method of imparting a three-point camber to the bottom chord 220, in which the bottom chord is jacked at three points along its span, to offset the load of the panels 125.

The three-point camber is applied with three jacks to the bottom chord 220 at a center points and two side points. A beam may be temporarily secured between the first and second end supports 110, 115 for the jacks or the jacks can be based on the floor. The ultimately-desired center camber (CC) and side cambers (SC) at the respective center point and side points are calculated with the following equations:

$$CC = d \times \left(\frac{h}{1200}\right) \times \left(\frac{w}{480}\right)^4$$

$$SC = CC + \left(\sqrt{r^2 - x^2}\right) - r$$

In which:

CC=center camber above at-rest level of the bottom chord (in.)

SC=side camber above at-rest level of the bottom chord (in.)

d=panel weight density (lbs/ft2)

h=modular height from floor, at-rest (in.)

w=span or opening width (in.)

$$r = \frac{s^2 + \ell^2}{2s} = \text{radius of arc (in.)}$$

$$\ell = \frac{w - 8}{2} = \text{adjusted half width (in.), accounting for small gap 560}$$

$$x = 1 - 120 = \text{horizontal offset (in.)}$$

As noted above, the heights to which the center and side points are jacked during assembly should overshoot the ultimately-desired cambers CC, SC calculated above, to account for relaxation of the top support assembly 120 after the camber has been applied.

The present invention also provides a method of retrofitting a substantially free-standing operable wall assembly that is operated manually into one operating under the influence of a prime mover 130 according to the present invention. The method of retrofitting includes the following steps:

1. Remove panels.
2. Remove truss.
3. Remove bottom chord.
4. Remove escapement channel.
5. Install new escapement channel.
6. Install new bottom chord.
7. Install return sprocket.
8. Camber per rules.
9. Torque all bolts.
10. Install new motor brackets.
11. Install outboard arm.
12. Install motor.
13. Install control box & limit switches.
14. Raise cap channel by 1 3/16".
15. Install spacers to vertical posts.
16. Hang the updated truss.
17. Install the chain.
18. If header side panels are used, install all new header side panel components.

In such a retrofit, the panels will need to be replaced with panels 125 according to the present invention or the panels themselves can be retrofit to the present system using the following steps:

a. If top mechanical seals are present, remove the seals.
b. Remove the carrier and carrier bracket.
c. Mount new aluminum rails and female carriers into the top of the panels.
d. Install new carriers.
e. The lead and stack panel will need to be replaced or will require cutting the modular width smaller. If cutting smaller, install corner brackets and re-mount the verticals.
f. Replace non-hinged bullnoses with hinged bullnoses.
g. Mount the stack jamb.
h. Install the panels.
i. Hinge all panels together by drilling holes in the previously non-hinged verticals.
j. Connect the chain to the lead carrier.
k. Verify limit switch locations and permanently mount.
l. Mount the key switches.

At a high level, the retrofit would include the basic steps of providing the prime mover 130 and interconnecting the chain 450 or other force transfer member between at least one of the operable wall panels 125 and the prime mover 130 such that the operable wall panels 125 are movable under the influence of the prime mover 130.

The retrofit process may include replacing the overhead track with a replacement overhead chord 220 having an integrally-formed runner 275 alongside a track 270, and supporting the chain 450 or other force transfer member with the runner 275. To install the chain 450, it is desirable to position the drive sprocket 430 at a first end of the replacement chord and position the return sprocket 440 at a second end of the replacement chord. The chain 450 can then be meshed with each of the sprockets 430, 440 and with the lead wall panel 125 (e.g., through the toothed plate 375). Once the prime mover 130 is engaged with the drive sprocket 430 (e.g., via the gear box 455 and transmission shaft 460), the prime mover 130 is able to rotate the drive sprocket 430 and transfer force to the wall panel 125 through the chain 450 and lead carrier 341.

Thus, the invention provides, among other things, a free-standing operable wall panel assembly that is deployed and stowed under the influence of a prime mover and control system. Various features and advantages of the invention are set forth in the following claims.

What is claimed is:

1. An operable wall assembly for use in a building having a floor, the operable wall assembly comprising:

first and second end supports transferring substantially the entire weight of supported portions of the operable wall assembly to the floor such that the operable wall assembly is substantially free standing;

a top support assembly supported at opposite ends by the first and second end supports, the top support assembly including a track, a space being bounded by the first and second end supports, top support assembly, and floor, the top support assembly includes a top rail, a bottom rail that includes the track and a runner extending along the track between the first and second end supports, and a truss assembly interconnected between the top rail and the bottom rail;

a plurality of wall panels suspended from the top support assembly and movable along the track between a deployed condition in which the wall panels close the space and a stacked condition in which the wall panels do not close the space, the wall panels are suspended from the track by way of a plurality of carriers connected to the wall panels and adapted to move along the track;

a prime mover; and a drive system supported by the first and second end supports and interconnected between prime mover and the wall panels to move the wall panels between the deployed condition and stacked condition under the influence of the prime mover, the drive system includes a flexible force transmitting member supported by the runner and extending from the first end support to the second end support and back to the first end support in a loop, wherein the runner extends along first and second opposite sides of the track such that the flexible force transmitting member extends in a loop along the first and second sides of the track.

2. The operable wall assembly of claim 1, wherein the flexible force transmitting member is interconnected between the prime mover and at least one of the wall panels.

3. The operable wall assembly of claim 1, wherein the flexible force transmitting member includes a chain interconnected between the prime mover and at least one of the wall panels.

4. The operable wall assembly of claim 1, wherein the runner supports moving portions of the flexible force transmitting member.

5. The operable wall assembly of claim 1, wherein the runner that is integrally formed with the track in the top support assembly and supports moving portions of the flexible force transmitting member.

6. The operable wall assembly of claim 1, wherein the runner is integrally formed with the track in the top support assembly and extends alongside the track between the first and second end supports and supporting moving portions of the flexible force transmitting member.

7. The operable wall assembly of claim 1, wherein the flexible force transmitting member includes a chain.

8. The operable wall assembly of claim 7, wherein the drive system includes a return sprocket proximate the second end support for turning the chainback toward the first end support.

9. The operable wall assembly of claim 8, wherein:

the prime mover includes a motor supported by the first and second end supports, the motor having a motor shaft;

the drive system includes a transmission operating in response to rotation of the motor shaft and a drive sprocket rotated by the transmission and interconnected with the chain proximate the first end support.

10. The operable wall assembly of claim 9, wherein the motor shaft extends horizontally and the drive sprocket rotates about a vertical axis.

11. The operable wall assembly of claim 9, wherein:

the top support assembly includes first and second oppositely-facing sides; and the motor and transmission are both mounted to the first side of the top support assembly.

12. The operable wall assembly of claim 1, further comprising a control system for controlling operation of the prime mover, wherein:

the top support assembly includes first and second oppositely-facing sides; and the prime mover and control system are both mounted to the first side of the top support assembly.

13. The operable wall assembly of claim 1, further comprising a control system for operating the prime mover, the control system include a limit switch to limit travel of the wall panels.

14. An operable wall assembly for use in a building having a floor, the operable wall assembly comprising:

first and second end supports transferring substantially the entire weight of the operable wall assembly to the floor such that the operable wall assembly is substantially free standing;

a top support assembly supported at opposite ends by the first and second end supports, the top support assembly including a track and a chain runner adjacent the track, a space being bounded by the first and second end supports, top support, and floor, a top rail, a bottom rail, and a truss assembly interconnected between the top rail and the bottom rail;

a plurality of wall panels suspended from the track of the top support assembly by way of a plurality of carriers connected to the wall panels and movable along the track between a deployed condition in which the wall panels close the space and a stacked condition in which the wall panels do not close the space;

a motor;

a drive sprocket rotated by the motor; and a chain supported by the chain runner and interconnected between a least one of the wall panels and the drive sprocket to move the wall panels between the deployed condition and stacked condition under the influence of the motor and chain, the chain extending from the first end support to the second end support and back to the first end support in a loop, wherein the bottom rail includes the track and the chain runner extending along the track between the first and second end supports, and wherein the chain runner extends along first and second opposite sides of the track such that the chain extends in a loop along the first and second sides of the track.

15. The operable wall assembly of claim 14, wherein the chain is interconnected between the motor and at least one of the wall panels.

16. The operable wall assembly of claim 14, wherein the chain runner is formed integrally with the track.

17. The operable wall assembly of claim 14, further comprising a transmission operably interconnecting the motor with the drive sprocket, wherein:

the motor includes a horizontal motor shaft; and the drive sprocket rotates about a vertical axis.

18. The operable wall assembly of claim 14, further comprising a control system including a controller for controlling the motor and at least one limit switch providing a signal to the controller for stopping the motor when the wall panels have reached the deployed condition.

19. The operable wall assembly of claim 14, further comprising:

a transmission operably interconnecting the motor with the drive sprocket; and a controller for the motor;

wherein the top support assembly includes first and second oppositely-facing sides; and wherein the motor, transmission, and controller are all mounted to the first side of the top support assembly.

* * * * *